US005415349A

United States Patent [19]

Gill

[11] Patent Number: 5,415,349

[45] Date of Patent: May 16, 1995

[54] LIQUID DISTRIBUTION ELEMENT

[75] Inventor: David C. Gill, Bristol, United Kingdom

[73] Assignee: Nomix Chipman Limited, Bristol, United Kingdom

[21] Appl. No.: 144,738

[22] Filed: Oct. 29, 1993

[30] Foreign Application Priority Data

Nov. 17, 1992 [GB] United Kingdom ..... 9224061
Jan. 20, 1993 [GB] United Kingdom ..... 9301059

[51] Int. Cl.[6] ..... B05B 3/10
[52] U.S. Cl. ..... 239/222.11; 239/224
[58] Field of Search ..... 239/214, 222.11, 223, 239/224, 225.1, 263.1

[56] References Cited

U.S. PATENT DOCUMENTS

| | | | |
|---|---|---|---|
| 442,865 | 12/1890 | De Kinder . | |
| 2,220,275 | 11/1940 | Preston . | |
| 2,671,650 | 3/1954 | Jauch et al. | 239/224 |
| 2,888,206 | 5/1959 | Waldrum . | |
| 3,073,531 | 1/1963 | Kothe . | |
| 3,085,749 | 4/1963 | Schweitzer et al. | 239/222.11 |
| 3,346,192 | 10/1967 | Hege . | |
| 3,455,507 | 7/1969 | Ryder et al. . | |
| 3,459,586 | 8/1969 | Kiwiet et al. . | |
| 4,094,468 | 6/1978 | Volle . | |
| 4,225,084 | 9/1980 | Bals . | |
| 4,294,408 | 10/1981 | Snyder et al. . | |
| 4,360,155 | 11/1982 | Hubbell et al. . | |
| 4,407,217 | 10/1983 | Jackson . | |
| 4,609,148 | 9/1986 | Gill . | |
| 4,901,920 | 2/1990 | Wollin | 239/222.11 |

FOREIGN PATENT DOCUMENTS

| | | |
|---|---|---|
| 470835 | 3/1976 | Australia . |
| 2351709 | 12/1977 | France . |
| 2362673 | 3/1978 | France . |
| 2559144 | 6/1977 | Germany . |
| 229178 | 2/1925 | United Kingdom . |
| 345714 | 4/1931 | United Kingdom . |
| 806848 | 12/1958 | United Kingdom . |
| 991973 | 5/1965 | United Kingdom . |
| 1005621 | 9/1965 | United Kingdom . |
| 1442662 | 7/1976 | United Kingdom . |
| 1515511 | 6/1978 | United Kingdom . |
| 2026904 | 2/1980 | United Kingdom . |
| 2123714 | 2/1984 | United Kingdom . |
| 2155816 | 10/1985 | United Kingdom . |

*Primary Examiner*—Karen B. Merritt
*Attorney, Agent, or Firm*—Merchant & Gould, Smith, Edell, Welter & Schmidt

[57] ABSTRACT

A rotary element for distributing a liquid such as a herbicide comprises liquid distributing projections (58) which have swept-back leading boundary surfaces (64) which are arcuately convex. Each projection (58) has a transverse surface (62) which is arcuately concave and extends forwardly from one axial end of the respective leading boundary surface (64), with respect to the direction of operative rotation of the element. This configuration enables the spray width of the liquid to be reduced.

11 Claims, 4 Drawing Sheets

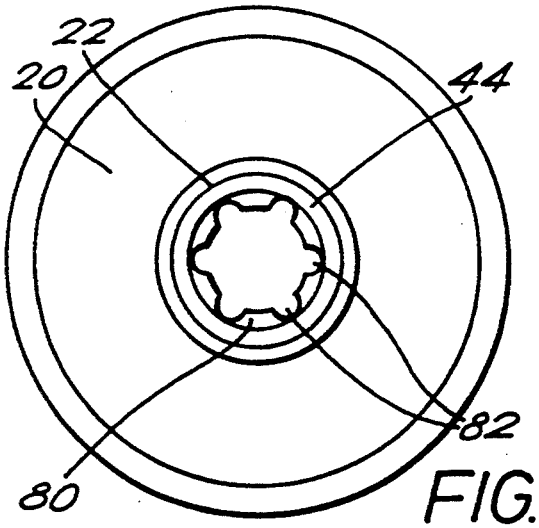
FIG.3.
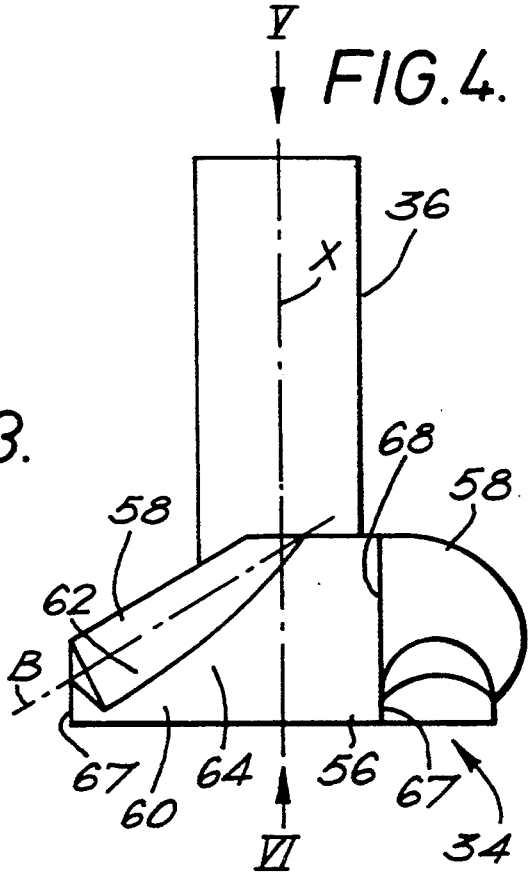
FIG.4.
FIG.6.
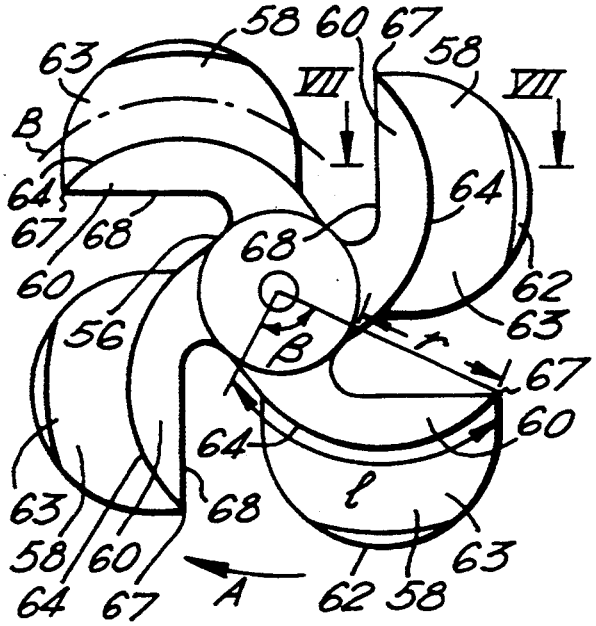
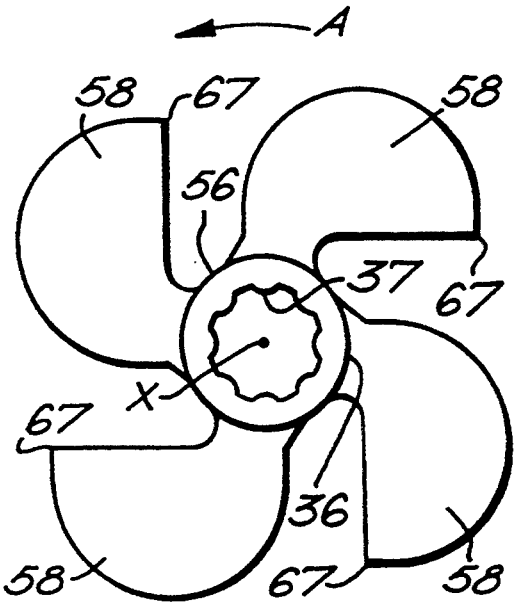
FIG.5.
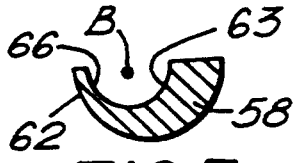
FIG.7.

FIG.9.
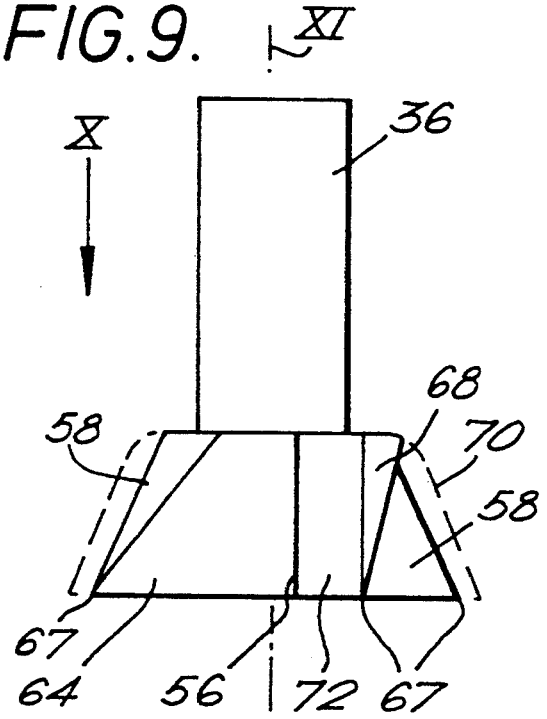
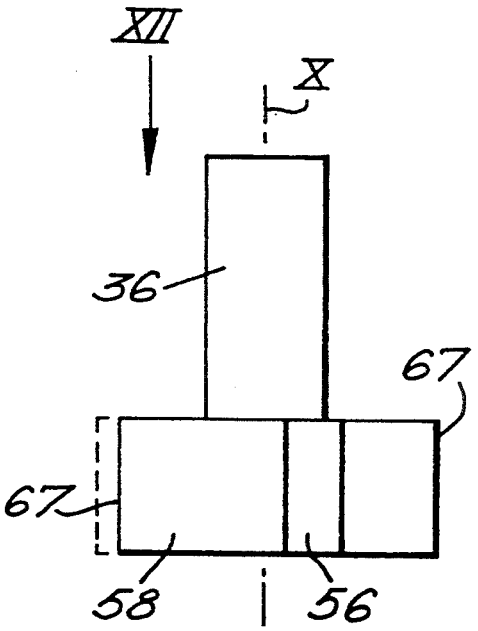
FIG.11.
FIG.10.
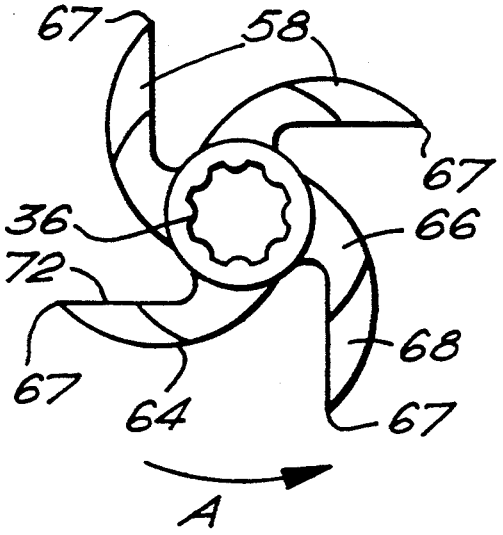
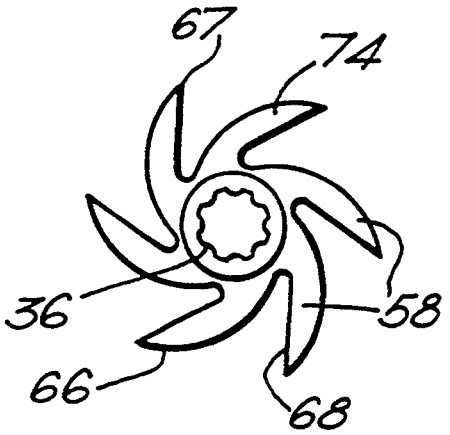
FIG.12.

LIQUID DISTRIBUTION ELEMENT

This invention relates to rotary distribution elements for discharging liquid in the form of droplets. Such distribution elements are used particularly, although not exclusively, in hand-held equipment for distributing herbicides, pesticides, or other agrochemicals.

GB-A-2223698 discloses a delivery head for distributing liquid such as herbicides, which delivery head includes a rotary distribution element for discharging the liquid in the form of droplets, the element comprising a hub defining a rotary axis of the element, from which hub projects a plurality of liquid distributing projections, each of which extends outwardly from the rotary axis and has a leading boundary surface and a trailing boundary surface, which boundary surfaces meet each other at a tip of the projection. In operation, the rotary element is oriented so that its rotary axis is approximately vertical, and the liquid is delivered to the rotary element from the delivery head through an annular passage which opens near the hub. The liquid then migrates across the rotary element and is discharged from the tips of the projections by centrifugal force.

GB-A-2223698 discloses both a relatively large diameter rotary element, in which the projections are in the form of serrations at its periphery, and a somewhat smaller, substantially square rotary element, in which the projections are constituted by the corners of the square. When a large spray width is required, the larger, serrated-periphery element is used, and when a relatively small spray width is required, the smaller, square element is used. Further variations in spray width are achieved by varying the rotation speed of the rotary element.

Even with the smaller, square rotary element, there is a minimum spray width which can be achieved while retaining the required droplet pattern. Even at this minimum spray width, the droplets fall to the ground in the form of a ring, with a diameter of approximately 15 cm, and this type of spray pattern is not suitable for the spot treatment of weeds. If the delivery head is held so that it is directly over the weed, the herbicide falls in a ring around the weed. If none of the herbicide droplets land on the weed, it will not be killed. Alternatively, if the delivery head is held so that part of the ring of herbicide droplets lands on it, the remainder of the ring misses the weed, which is wasteful and possibly damaging to nearby plants which are not meant to be killed.

The droplet pattern created by the rotary element is affected by the volume flow rate of liquid to the rotary element. At high flow rates (above 40 ml/minute), and at minimal rotational speed (approximately 1000 rpm), the droplets become too large, and are not ejected evenly around the periphery of the rotary element. In extreme cases, the liquid may simply pour over the rotary element and fall to the ground as a stream. This is because the energy available at the rotary element is insufficient to accelerate the liquid towards the periphery of the rotary element, and to overcome the surface tension of the liquid to cause it to break into fine droplets. The energy available can be increased by raising the rotational speed of the rotary element, but this increases the spray width.

According to the present invention, each liquid distributing projection is inclined to the radial direction so that, with respect to the direction of operative rotation of the element, it trails the region of the hub to which it is attached.

The leading boundary surface of each projection may be convexly curved as viewed in a direction parallel to the rotary axis.

Preferably, the radially innermost region of the leading boundary surface is inclined to the radial line passing through it, so as to trail that radial line, with respect to the direction of operative rotation of the element. The leading boundary surface, and, if it is convexly curved, its axis of curvature, may be parallel to the rotary axis of the element.

With a rotary element constructed in accordance with the present invention, the tip of each projection is situated behind the region at which the projection itself meets the hub, with respect to the direction of operative rotation of the element. For example, the angle at the rotary axis between the innermost end of the leading boundary surface and the tip of each projection may be greater than 45° . Preferably, this angle is greater than 60° and in a preferred embodiment having four projections, the angle is approximately 90° . Thus, the tip of each projection lies substantially on the same radial line as the innermost end of the leading boundary surface of the next following projection, with respect to the direction of operative rotation of the element.

In operation of a distribution element in accordance with the present invention, the liquid migrates from the hub across the leading boundary surface of each projection, and is discharged from the tip of that projection. Because the projection has a trailing orientation, and particularly if the leading boundary surface is convex, the length of the leading boundary surface (from the hub to the tip) is long, relatively to the radial distance of the tip from the hub. Preferably, the length of the leading boundary surface is at least 1.5 times, and preferably double, the radial distance of the tip from the hub. The liquid migrates across the leading boundary surface of each projection under the action not only of centrifugal force, but also of inertia, as the non-rotating liquid meets the rotating element. As a result, the liquid can be broken down into droplets as it reaches the tip of each projection, while minimising the momentum of each droplet in the radially outwards direction. Consequently, the droplet pattern will be in the form of a ring of smaller diameter than can be achieved with the known distribution elements, having substantially radially oriented projections, while maintaining the required droplet sizes. A distribution element constructed in accordance with the present invention is, therefore, more appropriate for the spot treatment of weeds, or other applications where a narrow spray width is required.

Further reduction in spray width can be achieved, while maintaining the desired droplet size, by providing a transverse surface at one axial end of the leading boundary surface of each projection, this transverse surface extending forwardly of the leading boundary surface with respect to the operative direction of rotation of the element.

The transverse surface is preferably concavely curved and merges smoothly into the leading boundary surface. The axis of curvature of the transverse surface may extend obliquely with respect to a plane perpendicular to the rotary axis, so that the transverse surface slopes downwardly in the direction towards the tip of the projection.

The axis of curvature of the transverse surface may be curved, as viewed in a direction parallel to the rotary axis. For example, if the leading boundary surface is convexly curved, the axis of curvature of the transverse surface may be parallel to the leading boundary surface.

The hub of the rotary distribution element may have a shank for supporting the element on the output shaft of a motor. In a preferred embodiment of a delivery head, the shank may extend into a tubular nose of the delivery head. The delivery head preferably has an annular passage through which liquid to be distributed is supplied to the shank. The interior of the tubular nose may have axially extending grooves for guiding the liquid along the shank towards the hub and for distributing the liquid evenly around the rotary axis before it meets the projections.

For a better understanding of the present invention, and to show more clearly how it may be carried into effect, reference will now be made, by way of example, to the accompanying drawings, in which:

FIG. 3 is a view, taken on the line III—III in FIG. 2, of an outer component of the delivery head;

FIG. 4 is an enlarged side view of a distribution element carried by the delivery head of FIG. 2;

FIG. 5 is a view of the distribution element taken in the direction of the arrow V in FIG. 4;

FIG. 6 is a view of the distribution element taken in the direction of the arrow VI in FIG. 4;

FIG. 7 is a sectional view taken on the line VII—VII in FIG. 6;

FIG. 9 is a side view of an alternative embodiment of a distribution element;

FIG. 10 is a view taken in the direction of the arrow X in FIG. 9;

FIG. 11 is a side view of a third embodiment of a distribution element; and

FIG. 12 is a view taken in the direction of the arrow XII in FIG. 11.

Figure 1:
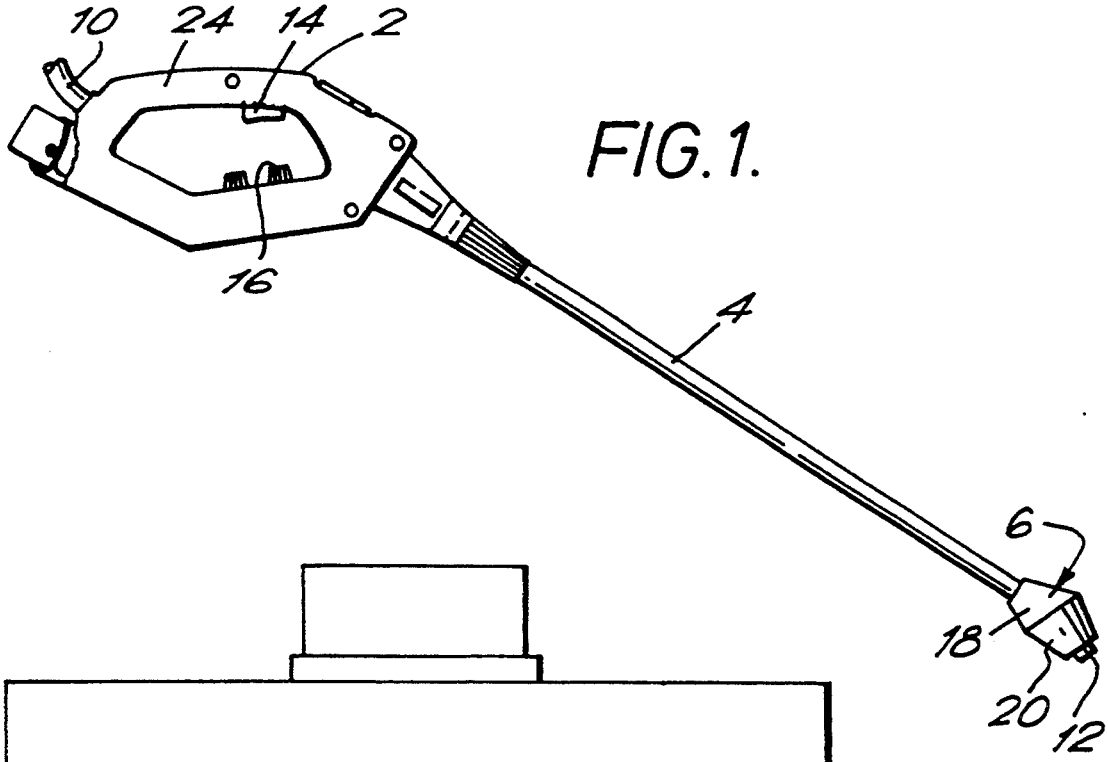
FIG. 1 is a side view of herbicide delivery equipment.

The equipment shown in FIG. 1 comprises a handset 2 to which is connected, by a support tube 4, a delivery head 6. The handset 2 is provided with a flexible tube 10 which leads to a container of herbicide. The flexible tube 10 is connected, by a valve in the handset 2, to a further flexible tube which extends down the support tube 4 to a rotary distribution element 12 on the delivery head 6.

The handset 2 accommodates control circuitry for controlling a motor 13 (FIG. 2) for driving the distribution element 12. The handset 2 also accommodates a battery for supplying electrical power to the motor in the delivery head 6. A trigger 14 is provided on a handle member 24 of the handset 2 and serves the dual function of opening a valve in the fluid supply line to the head 6 and of closing a switch to provide power to the motor 13. The motor speed can be adjusted by means of a control knob 16.

Figure 2:
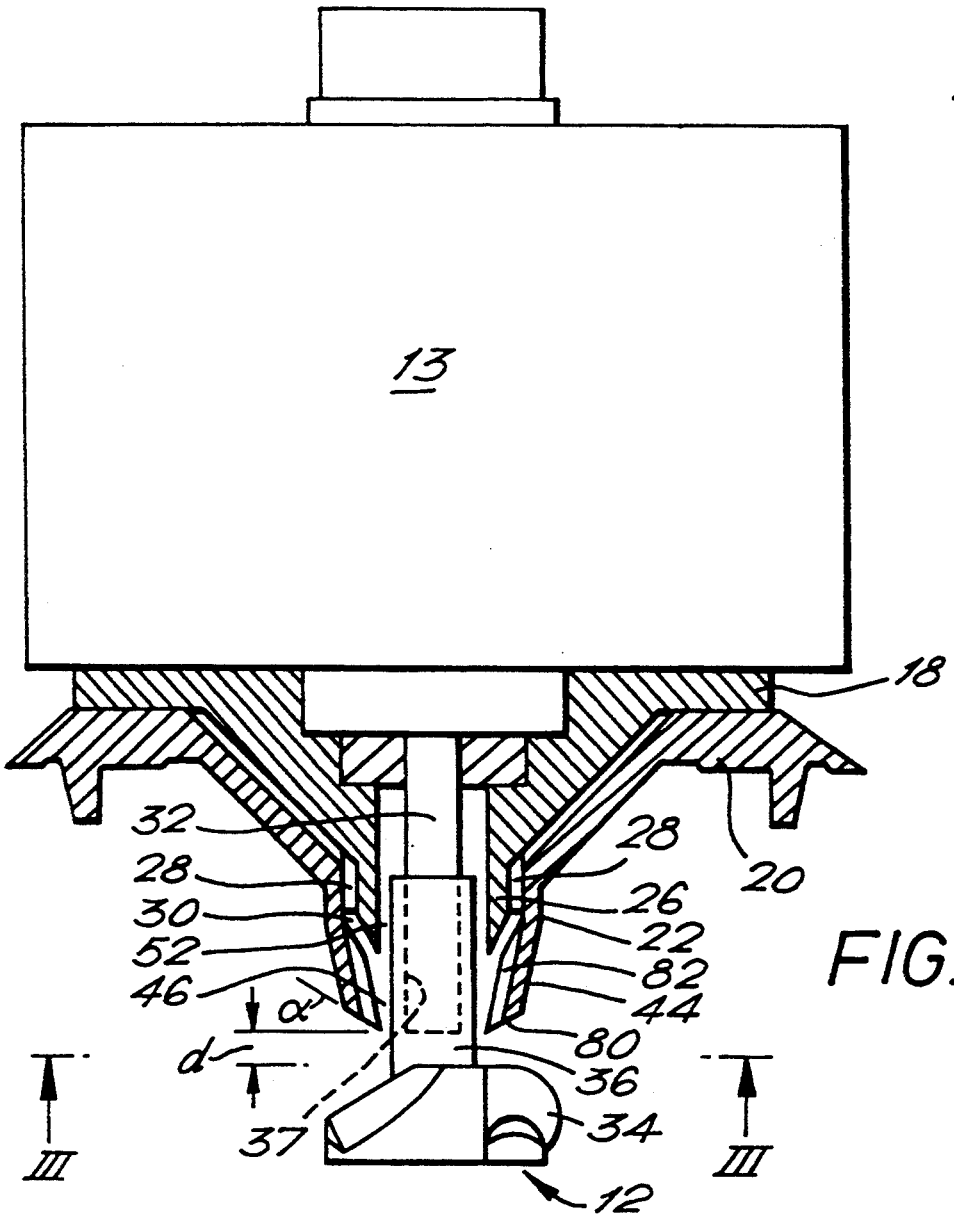
FIG. 2 is an enlarged, partly sectioned, side view of a delivery head forming part of the equipment shown in FIG. 1.
Figure 8:
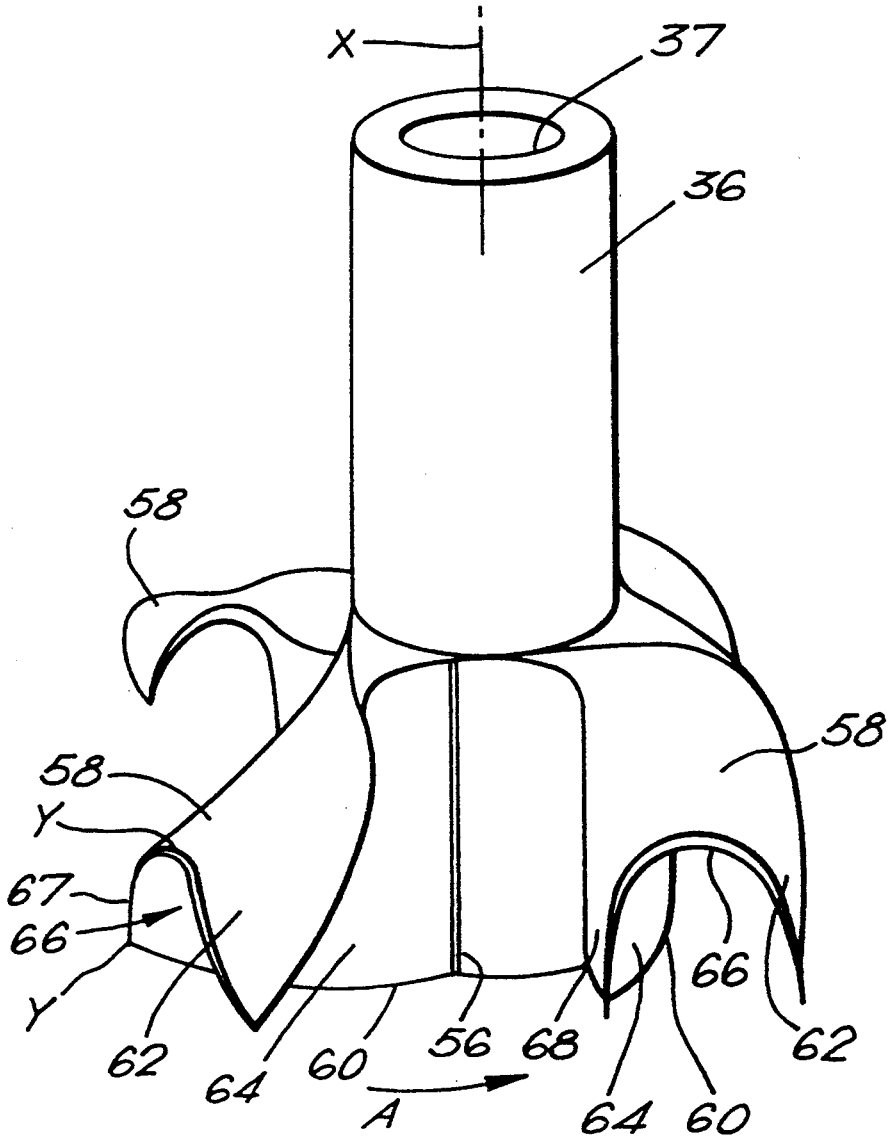
FIG. 8 is a perspective view of the distribution element of FIGS. 5 to 7.

The delivery head 6 comprises two components 18 and 20. As shown in FIG. 2, the component 20 has a tubular nose 22 within which fits a cylindrical protection 26 of the component 18. The projection 26 has, on its outer surface, a series of ribs 28 which centre the protection 26 in the circular nose 22. As a consequence, an annular passage 30 is formed between the tubular nose 22 and the cylindrical projection 26.

The motor 13 has an output shaft 32, on which is fitted the rotary distribution element 12. This rotary distribution element 12 has a body 34 from which extends a shank 36 having a closed bore 37 which receives the output shaft 32 of the motor 13.

Operation of the trigger 14 causes power to be supplied to the motor 13 to drive the distribution element 12 in rotation, and also causes herbicide to flow from the handset 2 to the delivery head 6, and then through the annular passage 30 to the distribution element 12. Owing to the rotation of the distribution element 12, the herbicide is ejected from its periphery in the form of fine droplets.

The outer component 20 has an extended lip 44 which has a conical form, extending obliquely inwardly towards the shank 36. This provides an inwardly directed mouth 46 of the annular passage 30. The lip 44 terminates at an oblique edge 80 which is inclined to the rotary axis at an angle a which is in the range 30° to 50°. The edge 80 terminates at a distance d of approximately 0.5 mm from the body 34 of the element 12.

The internal surface of the lip 44 has a series of grooves 82 which, as shown in FIG. 3, open at the edge 80 as an annular array of notches distributed around the shank 36.

The distribution element 12 is shown in greater detail in FIGS. 4 to 8. The body 34 has four projections 58 which extend outwardly from a hub 56 situated at one end of the shank 36.

Each projection 58 has a generally axially extending portion 60 and what can be regarded as a turned-over portion 62. The turned-over portion 62 is directed forwardly of the axial portion 60, with reference to the operative direction of rotation indicated by an arrow A.

The axial portion 60 has a somewhat swept-back appearance, having a leading boundary surface 64 which is convex as viewed axially (i.e. as seen in FIG. 6). In the embodiment shown in FIGS. 4 to 8, the leading boundary surface 64 is arcuate. The axial portion 60 of each projection 58 also has a trailing boundary surface 68 which is flat and extends axially and substantially tangentially to the outer surface of the hub 56. The leading boundary surface 64 meets the trailing boundary surface 68 at a tip 67, in the form of an edge which is parallel to the rotary axis X.

The turned-over portion 62 of each projection 58 has a transverse surface 63 which is directed downwardly in the normal operational orientation of the element 12 (as shown in FIG. 2). This transverse surface 63 is generally in the form of a continuously curved extension of the leading boundary surface 64 of the axial portion 60, and is curved about an axis of curvature B. The axis of curvature B, as seen in FIG. 6, is parallel to the corresponding leading boundary surface 64, and, as seen in FIG. 4, lies in a plane which is oblique with respect to the rotary axis X of the element 12. Consequently, as can be appreciated from FIGS. 6 and 7, the turned-over portions 62 each provide a curved channel 66 which follows the arcuately swept-back configuration of the adjacent leading boundary surface 64, and slopes downwardly (when the element 12 is in the normal operational position represented in FIG. 2) from its radially innermost end to its radially outermost end.

It will be appreciated from FIG. 6 that each projection subtends an angle B of approximately 90° at the rotary axis X. Also, the length l of the leading boundary surface is approximately double the radial distance r between the outer surface of the hub 56 and the tip 67.

In operation, herbicide reaching the element 12 through the mouth 46 of the annular passage 30 initially contacts the outer surface of the shank 36, and flows downwardly towards the distribution body 34. The grooves 82 assist in assuring an even distribution of the herbicide around the surface of the shank 36. Although the shank 36 is rotating, the outer region of the film of liquid on the shank 36 is not instantaneously accelerated up to the speed of rotation of the shank 36. Consequently, when the liquid reaches the distribution body 34, it is rapidly accelerated by contact with the forwardly directed surfaces 64 and is impelled, by inertia forces and by centrifugal force, towards the tips 67 of the projections 58. The liquid migrates across the leading boundary surface 64 and the transverse surface 63 of the channel 66 in the form of a film and is ejected from the outer edge of each projection generally between the points Y and Y in FIG. 8. Also, the rotation of the element 12 causes air to be scooped into the channels 66 and discharged from their outer ends with a downwards component of direction. In operation, therefore, the fine droplets of liquid which are discharged from the element have a relatively low momentum in the radially outwards direction and are directed downwardly by the streams of air emerging from the channels 66. The droplets therefore fall to the ground within a relatively small circular area centred on the rotary axis X of the element.

Although the embodiment shown in FIGS. 4 to 8 has been found to give the desired droplet pattern in a relatively confined area, adequate results have also been achieved using rotary elements which do not have the turned-over portions 62 on the projections 58. One such element is shown in FIGS. 9 and 10. In this embodiment, each projection 58 has generally the same configuration as the axial portion 60 of the projections 58 of the embodiment of FIGS. 4 to 8. Thus, each projection 58 has a swept-back configuration with respect to the direction of rotation A. Each projection 58 has a liquid-receiving surface which, in use, faces towards the delivery head and which comprises a root portion 66 and a tip portion 68. The root portion 66 is substantially perpendicular to the rotary axis X, while the tip portion 68 is inclined to the root portion 66 at an angle of 23° so that the element as a whole, as shown in FIG. 9, has a generally conical envelope 70 with a vertex angle of 46°. Each projection 58 has a leading boundary surface 64, which is arcuately convex as seen in FIG. 10, and a trailing boundary surface 72 which is flat.

The embodiment of FIGS. 11 and 12 is, in many respects, similar to that of FIGS. 9 and 10, except that the liquid-receiving surface of the element is generally perpendicular to the rotary axis X over its full extent, there being no inclined portion corresponding to the tip portion 68 in the embodiment of FIGS. 9 and 10. Consequently, as viewed in FIG. 11, the distribution body 34 has a rectangular appearance, instead of the conical appearance of the embodiment of FIGS. 9 and 10. Also, the embodiment of FIGS. 11 and 12 has six projections 58 instead of the four projections provided in the embodiments of FIGS. 4 to 10. It will be appreciated that other numbers of projections 58 could be provided.

Tests have been conducted on a distribution element 12, having the configuration shown in FIGS. 4 to 8 with the following dimensions.

| | |
|---|---|
| Overall diameter | 11 mm |
| Axial height of distribution body | 3.5 mm |
| Diameter of shank 36 | 3.2 mm |
| Radius of curvature of leading boundary surfaces 64 | 3 mm |
| Radius of curvature of axis B | 1.4 mm |
| Angle between plane of axis B and rotary axis X | 30° |
| Ratio 1/r | 2 |

The tests were performed using herbicides of which the viscosities, measured in accordance with British Standard 3900 A6 using a Stanhope Seta No. 2 cup (100 m/s) at 20° C. were such that flow times of 40 to 120 seconds were obtained.

The distribution element 12 was operated at rotational speeds in the range 1000–4000 rpm and was used to distribute the herbicides at flow rates up to 60 ml/minute.

It was found that the distribution element gave a droplet pattern of consistently-sized fine droplets falling within a circular area of 8 to 50 cm. Most of the droplets fell near the periphery of the circular area, but a significant number fell nearer the centre of the area.

It was also found that a satisfactory spraying pattern was achieved even if the axis X was not vertical, the droplets being impelled away from the distribution body in a direction having a significant component parallel to the axis X.

I claim:

1. A rotary distribution element (12) for discharging a liquid in the form of droplets, the element comprising a hub (56) defining a rotary axis (X) of the element, from which hub (56) projects a plurality of liquid distributing projections (58), each of which extends outwardly from the rotary axis (X) to a tip (67) from which liquid is discharged in operation, and each of which has a leading boundary surface (64) and a trailing boundary surface (68), which boundary surfaces (64,68) lie substantially parallel to the rotary axis (X) and meet each other at the tip (67) of the projection (58), characterised in that with respect to the direction (A) of operative rotation of the element, each projection (58) trails the region of the hub (56) to which it is attached; characterised in that the leading boundary surface (64) is convex as viewed parallel to the rotary axis (X).

2. A rotary distribution element as claimed in claim 1, characterised in that the convex leading boundary surface (64) is arcuate.

3. A rotary distribution element as claimed in claim 2, characterised in that a transverse surface (63) is provided at one axial end of the leading boundary surface (64) of each projection (58), the transverse surface (63) extending forwardly of the leading boundary surface (64) with respect to the direction (A) of operative rotation of the element.

4. A rotary distribution element as claimed in claim 3, characterised in that the transverse surface (63) of each projection (58) merges smoothly into the respective leading boundary surface (64).

5. A rotary distribution element as claimed in claim 3, characterised in that the transverse surface (63) of each projection (58) is concavely curved about an axis (B) which is parallel to the respective leading boundary surface (64).

6. A rotary distribution element as claimed in claim 5, characterised in that the axis (B) of curvature of the transverse surface (63) of each projection (58) extends obliquely to a plane which is perpendicular to the rotary axis (X).

7. A rotary distribution element as claimed in claim 6, characterised in that the axis (B) of curvature of the transverse surface (63) slopes towards the other axial end of the respective leading boundary surface (64) in the direction away from the rotary axis (X).

8. A rotary distribution element as claimed in claim 7, characterised in that the transverse surface (63) presents a channel-shaped profile as viewed in a transverse cross-section of the respective projection (58).

9. A rotary distribution element as claimed in claim 8, characterised in that the tip (67) of each projection (58) comprises a sharp edge which is parallel to the rotary axis (X).

10. A delivery head for distributing liquids, the head comprising a rotary distribution element in accordance with claim 9, the element having a shank (36) which is received in a tubular nose (22) of the head, the tubular nose (22) having axially directed grooves (82) on its internal surface facing the shank (36).

11. A delivery head as claimed in claim 10, characterised in that the tubular nose (22) has an oblique end face (80), the grooves (82) terminating in notches at the end face (80).

* * * * *